US006874215B2

(12) United States Patent
Flippin

(10) Patent No.: US 6,874,215 B2
(45) Date of Patent: Apr. 5, 2005

(54) METHOD OF MAKING MATTRESSES

(75) Inventor: J. Patrick Flippin, Mebane, NC (US)

(73) Assignee: Kingsdown, Incorporated, Mebane, NC (US)

( * ) Notice: Subject to any disclaimer, the term of this patent is extended or adjusted under 35 U.S.C. 154(b) by 56 days.

(21) Appl. No.: 10/403,524

(22) Filed: Apr. 1, 2003

(65) Prior Publication Data

US 2004/0194270 A1 Oct. 7, 2004

(51) Int. Cl.[7] ..... B68G 7/00; D05B 11/00
(52) U.S. Cl. ..... 29/91.1; 29/91; 112/2.1
(58) Field of Search ..... 29/91.1, 91; 112/2.1, 112/475.06, 475.08

(56) References Cited

U.S. PATENT DOCUMENTS

| | | | | |
|---|---|---|---|---|
| 2,336,952 | A | | 12/1943 | Olson |
| 3,031,985 | A | | 5/1962 | Kalning et al. |
| 3,173,159 | A | | 3/1965 | Hart |
| 3,641,954 | A | | 2/1972 | Kalning et al. |
| 3,737,929 | A | | 6/1973 | Golembeck |
| 4,019,451 | A | | 4/1977 | Autrey |
| 4,189,797 | A | | 2/1980 | Glackin |
| 4,286,344 | A | | 9/1981 | Ikeda |
| 4,463,466 | A | | 8/1984 | May et al. |
| 5,117,519 | A | | 6/1992 | Thomas |
| 5,475,881 | A | | 12/1995 | Higgins et al. |
| 5,501,164 | A | | 3/1996 | Porter et al. |
| 5,586,511 | A | * | 12/1996 | Porter et al. ..... 112/2.1 |
| 5,655,241 | A | | 8/1997 | Higgins et al. |
| 5,782,190 | A | | 7/1998 | Porter et al. |
| 6,098,224 | A | | 8/2000 | Gladney |
| 6,263,532 | B1 | | 7/2001 | Miller |
| 6,293,313 | B1 | | 9/2001 | McCrink |
| 6,408,773 | B2 | | 6/2002 | Resta |
| 2002/0144352 | A1 | | 10/2001 | Freeman et al. |

* cited by examiner

*Primary Examiner*—John C. Hong
(74) *Attorney, Agent, or Firm*—Shoemaker and Mattare

(57) ABSTRACT

A pillow top mattress is made by first sewing a mattress core border to respective pillow top borders, forming mitered corners on each, then pulling the combined borders over the mattress core, securing the combined borders to the core material, and then adding pillow top insulation and sewing a pillow top panel to the free edge of each pillow top border.

4 Claims, 2 Drawing Sheets

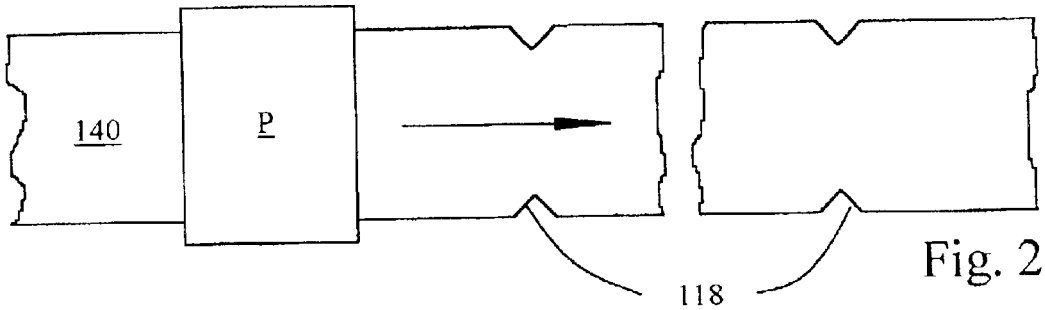
Fig. 2a
Fig. 2b
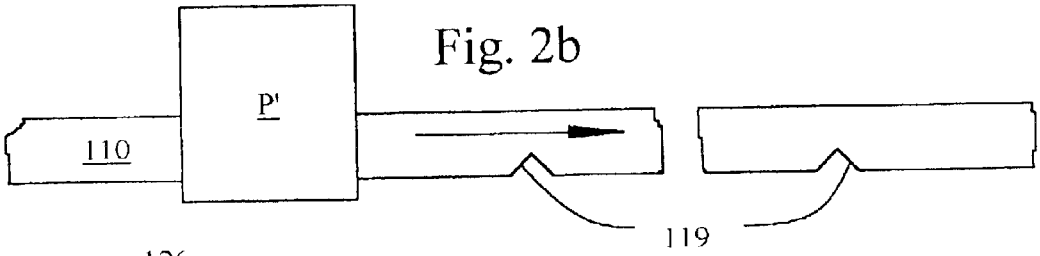
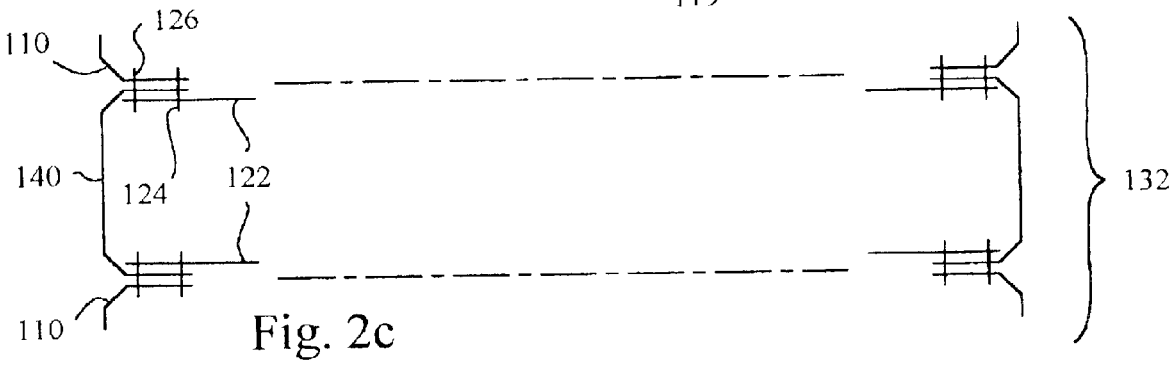
Fig. 2c
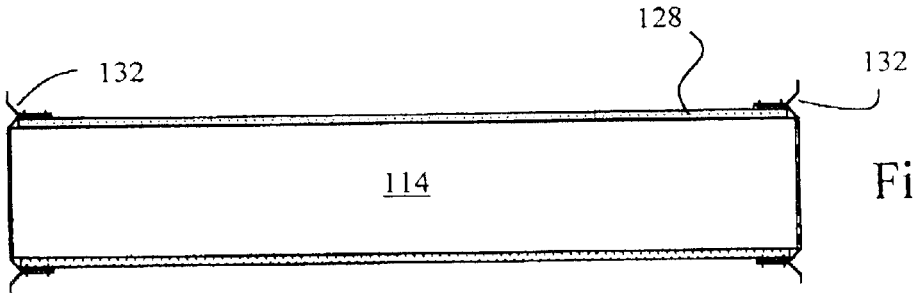
Fig. 2d
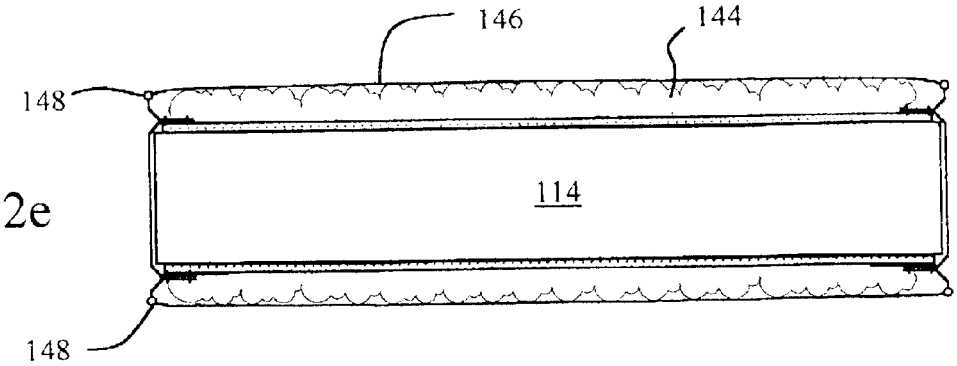
Fig. 2e

METHOD OF MAKING MATTRESSES

BACKGROUND OF THE INVENTION

This invention relates to an improved method of making mattresses.

A standard mattress comprises a core contained within an attractive fabric envelope. Most commonly, the core includes an inner spring assembly comprising an array of coil springs, covered top and bottom by pads of felt or other material. Alternatively, the core may be made of foam, or closed chambers containing water or air. Whatever the core construction, it is covered by an envelope made of top and bottom pieces of textile fabric whose edges are interconnected by sewing to a fabric border strip that runs around the periphery of the mattress. The seams may be protected by a decorative fabric tape.

Mattresses may, in addition, have a "pillow top" attached to the top of the mattress (and to the bottom also, if the mattress is to be reversible). While the pillow top contains its own padding, distinct from that of the core mattress, it is not separable, and in fact is sewn to the mattress. The pillow top appears to be separate, however, because corners are formed at the top of the mattress border, and at the bottom of the pillow top border, so that a neck is formed in the material. In profile, there is a V-shaped indentation at the mattress-pillow top interface. Although sewn together, the pillow top and the core mattress components are—and appear to be—distinct, being made from separate pieces of cloth and padding. The construction of pillow-top mattresses is complex, and involves a good deal of hand work, plus seam closure steps which require an operator to guide a mobile sewing machine around the periphery of the partially assembled mattress.

A pillow top mattress having, for example, an inner spring core is currently made by the following steps (where the steps numbers match the figures which illustrate them).

1*a*. A pillow top border 10 strip, folded lengthwise, is attached to a strong, inelastic polyester non-woven sheet 12, slightly larger than the inner spring 14, by stitching 16 at an offset distance of about two inches inward from the periphery of the sheet. The person doing the sewing lays out vee-shaped miter notches 18 where the corners are to be, and sews the edges of the miters together to form corner seams 20, during this step.

1*b*. A strip of strong non-woven material ("flange") 22 is then attached to the product of step (1*a*), by two parallel lines of stitching, one (24) at the edge of the sheet, and one (26) between the edge and the stitches applied in step (1*a*).

1*c*. Padding 28 is applied to the top and bottom of a core 14. Now the product 32 of step (1*b*) is placed over the core and padding, and is secured to the core by clips applied at intervals of several inches. The assembly is inverted, and a second product 32 is applied in a similar manner (if the mattress is to have pillow tops on both sides; for a non-reversible mattress, the bottom border may be simply seamed to a bottom sheet or quilted panel).

1*d*. Now a core border strip 40 is placed around the inner spring, and the core border strip is connected to the flange 22 by machine sewing, adding a tape 42 over the seam simultaneously.

1*e*. Padding 44 is then adhered to both the top and bottom of the mattress, and a pillow top 46 panel is placed over the padding. The panel is sewn to the top edge of the border strip by a hand-guided track-mounted sewing machine (not shown) which adds a tape 48 to the seam as it unites the materials.

Similar methods are used to produce mattresses not having inner springs, in which case the core border is attached to the core by appropriate alternative methods, such as by adhesion or by anchors attached to the core.

SUMMARY OF THE INVENTION

An object of the invention is to simplify the manufacture of pillow-top mattresses, and particularly to reduce the amount of tedious hand cutting and sewing required.

Another object is to reduce the amount of material required to make a pillow-top mattress, in particular to reduce the amount of seam tape required. A related object is to reduce waste.

It is a further object to improve the appearance of pillow-top mattresses.

These and other objects are attained by the method described below.

BRIEF DESCRIPTION OF THE DRAWINGS

In the accompanying drawings,

FIGS. 2*a* and 2*b* are diagrammatic top plan views of preliminary steps of making a mattress according to the present invention; and FIGS. 2*c*–2*e* are diagrammatic side views which illustrate the subsequent steps the present invention (described below).

DESCRIPTION OF THE PREFERRED EMBODIMENT

Figure 1A:
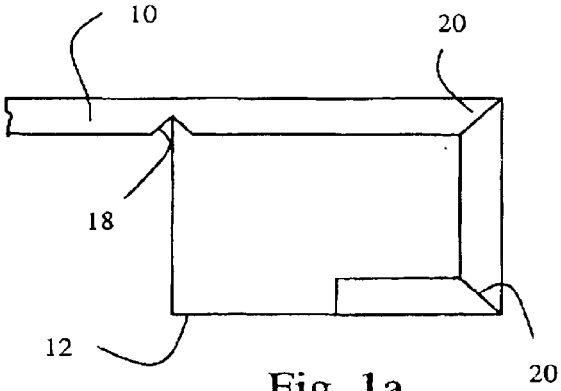
Fig. 1a (PRIOR ART)
FIG. 1*a* is a diagrammatic top plan view of a first step of making a pillow top mattress, according to the current state of the art described above.
Figure 1B:
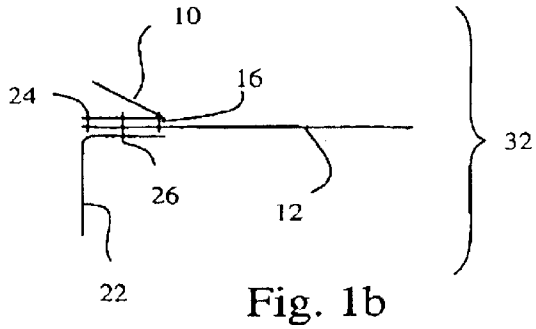
Fig. 1b (PRIOR ART)
FIGS. 1*b*–1*e* are diagrammatic side views showing successive steps of the method.
Figure 1C:
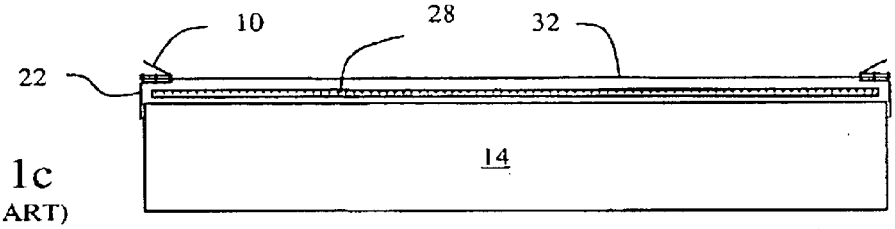
Fig. 1c (PRIOR ART)
Figure 1D:
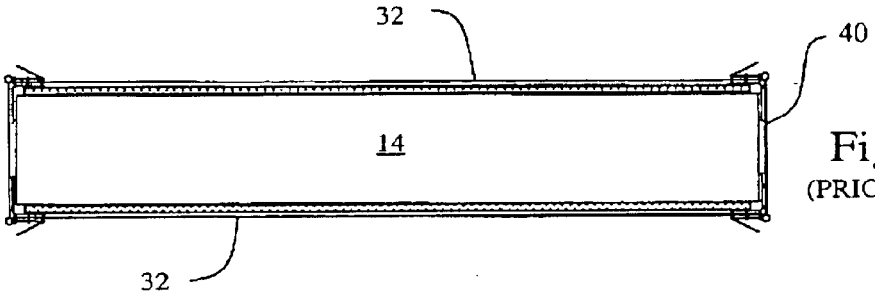
Fig. 1d (PRIOR ART)
Figure 1E:
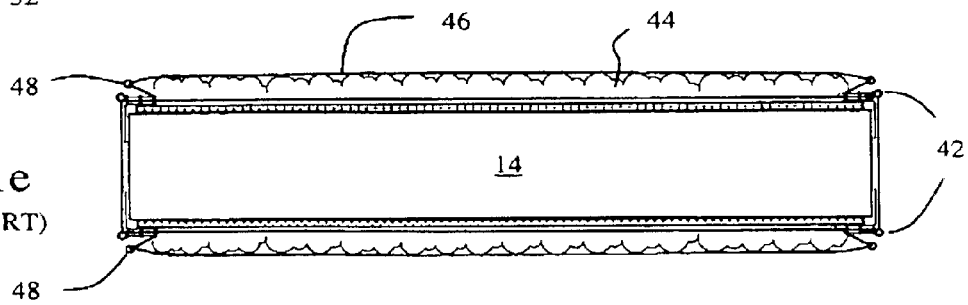
Fig. 1e (PRIOR ART)

According to the present invention, a pillow-top mattress is made by the following method steps, shown in correspondingly numbered drawings:

2*a*. Precut miter notches 118 with a machine P along at least one edge of a strip 132 of core border material at intervals determined according to the size of the mattress being produced.

2*b*. Precut miter notches 119 with a machine P' along one edge of a pillow top border strip 110 at the same intervals as in step 2*a*. The separate machines P, P' might be integrated into a single device, or they might actually be the same device, set up to alternately notch pillow top border strips and core border strips.

2*c*. Attach a strip of non-woven material ("flange") 122 to both the pillow top strip 110 and the core border strip 140 by two lines of stitching, one (124) at the aligned edges of the strips, and one (126) offset from the edge about an inch inward. Repeat this step along the other edge of the core border, if making a reversible mattress with two pillow tops, matching the notches of the border strips 110, 140 so that they are laterally opposed. For a single pillow top mattress, the bottom edge of core strip may be mitered at the corners, or it may be subsequently joined by taping to a bottom sheet (not shown) without mitering.

2*d*. Apply padding 128 to the top and bottom of a mattress core 114, which may be an inner spring, or a block of foam, or other material. Now pull the product 132 of step (2*c*) over the core, and secure it to the core, for example to the coils of the inner spring, if one is present, or to the padding material by clips or adhesive or other means, at intervals of several inches.

2*e*. Adhere padding or insulation 144 to both the top and bottom of the mattress, place a pillow top panel 146 over the padding, and close the pillow top with a sewing machine which adds a tape 148 to the seam as it goes. Repeat for the second pillow top, if the mattress is reversible.

Comparing this method with the prior art method discussed previously, one can see that the manufacturing process is considerably simplified. The miter notches are now formed automatically, avoiding the need to lay them out and cut them by hand. The top sheet has been eliminated altogether. The core border and pillow top border(s) are preassembled before they are applied to the mattress so that, most significantly, the core and border strips do not have to be sewn together after they have been associated with the core. The only seams that need be sewn after the core has been added to close the mattress are those around the top edge of the pillow tops(s).

The above steps are a preferred example. As an alternative to stitching, other means of attachment, such as pinsonic welding, may be used.

Since the invention is subject to modifications and variations, it is intended that the foregoing description and the accompanying drawings shall be interpreted as only illustrative of the invention defined by the following claims.

I claim:

1. A method of making a pillow-top mattress, said method comprising steps of precutting miter notches along at least one edge of a core border strip at intervals determined according to the size of the mattress being produced, precutting miter notches along one edge of a strip of pillow top border material at the same intervals as in the pillow top border, attaching a flexible reinforcing flange to both one edge of the pillow top strip and one edge of the core strip, leaving one edge of the pillow top strip free, and joining edges of the miter notches together for form a combined border strip having preformed mitered corners, pulling the combined border strip over a mattress core, placing pillow top padding on at least one side of the core, placing a pillow top panel over the padding, and sewing the pillow top panel at its periphery to the free edge of the pillow top border.

2. The method of claim 1, wherein the precutting steps are performed automatically.

3. The method of claim 1, wherein the core comprises an inner spring, and the method comprises a step of connecting the combined border strip to the inner spring.

4. The method of claim 1, wherein the core comprises a block of foam material.

* * * * *